United States Patent [19]

Talbot

[11] 4,316,107

[45] Feb. 16, 1982

[54] MULTIPLIER CIRCUIT

[75] Inventor: Daniel B. Talbot, Hudson, Mass.

[73] Assignee: DBX, Inc., Newton, Mass.

[21] Appl. No.: 16,148

[22] Filed: Feb. 28, 1979

[51] Int. Cl.[3] ..... G06G 7/24; G06G 7/12

[52] U.S. Cl. ..... 307/492; 328/144; 328/145; 328/160

[58] Field of Search ..... 307/229, 230, 492; 328/144, 145, 160

[56] References Cited

U.S. PATENT DOCUMENTS

| | | | |
|---|---|---|---|
| 2,842,664 | 7/1958 | Martin | 328/160 |
| 3,152,250 | 10/1964 | Platzer | 328/145 |
| 3,714,462 | 1/1973 | Blackmer | 328/160 |
| 3,938,038 | 2/1976 | Campbell | 328/160 |
| 4,038,566 | 7/1977 | Evans | 307/229 |

OTHER PUBLICATIONS

A Simple Electronic Multiplier by H. Norsworthy, Electronic Eng., 2/54, pp. 72–74, vol. 26, No. 312.

*Primary Examiner*—Stanley D. Miller, Jr.
*Assistant Examiner*—B. P. Davis
*Attorney, Agent, or Firm*—Schiller & Pandiscio

[57] ABSTRACT

A multiplier circuit for controlling gain amplification of an electrical input signal responsively to a control signal comprises log conversion means for producing a log signal as a logarithmic function of the input signal, means for producing a multiplier signal as a function of the sum of the log signal and the control signal and antilog-conversion means for producing an antilog signal as an antilogarithmic function of the multiplied signal. The improvement is characterized by the log conversion means and antilog conversion means each including passive elements capable of exhibiting log-linear and antilog-linear transfer characteristics. The passive elements are preferably in the form of diode elements connected in a diode bridge.

6 Claims, 4 Drawing Figures

MULTIPLIER CIRCUIT

The present invention relates to multiplier circuits and more particularly to circuits having a voltage controlled gain.

Multiplier circuits having a voltage controlled gain are well known. A common class of such circuits is the voltage controlled amplifier or VCA. Once variety of VCA can be referred to as the feedback or closed loop VCA since it generally includes a feedback loop as part of the circuit topology. An example of such a VCA which has met with immense commercial success is the type described in U.S. Pat. No. 3,714,462 issued to David E. Blackmer on Jan. 30, 1973. The latter type of VCA comprises an input operational amplifier having a pair of feedback paths through respective active circuit elements of opposite conductivity which elements exhibit log-linear transfer characteristics, e.g. collector-emitter circuits of opposite conductivity transistors, to form a first bipolar circuit for converting an input signal to a log form. Each transistor of the bipolar circuit has connected to it another transistor for converting the log signal into its antilog. A second operational amplifier is used as an output buffer for the resulting confined output signals from the antilog transistors. The gain of this VCA can be controlled by adding a variable DC voltage control signal to the log signal outputs of the bipolar circuit prior to their conversion to the antilog form.

Another variety of VCA can be called the open loop variety since such circuits do not employ a closed loop circuit topography, but instead an open loop one. An example of the latter type is described in U.S. Pat. No. 4,038,566 issued to Ronald C. Evans on July 26, 1977. The latter also employs active circuit elements and specifically the collector-emitter paths of NPN and PNP transistors for their log and antilog signal conversion characteristics.

Although these prior art VCAs have their various advantages, they usually employ matching transistors of opposite polarity and thus may be difficult to manufacture in integrated form.

Accordingly, it is an object of the present invention to provide a multiplier circuit easily capable of being manufactured in an integrated form or of components presently commercially-available in integrated form.

Another object of the present invention is to provide an improved multiplier circuit in which the log and antilog signal converting means include passive elements exhibiting log-linear and antilog-linear transfer characteristics.

And another object of the present invention is to provide an improved multiplier circuit having a circuit topology such that passive diode elements, such as diodes or transistors connected in a diode mode can be used for their log and antilog conversion characteristics.

Still another object of the present invention is to provide a VCA of the open loop variety useful for processing audio signals and having greater frequency response when compared with the frequency responses of many closed or open-loop VCAs making it potentially useful for video signal processing and gain control.

These and other objects are achieved by a multiplier circuit for controlling gain amplification of an electrical input signal responsively to a control signal and being of the type comprising log conversion means for producing a log signal as a logarithmic function of the input signal, means for producing a multiplied signal as a function of the sum of the log signal and the control signal and antilog-conversion means for producing an antilog signal as an antilogarithmic function of the multiplied signal. The improvement is characterized in that the log conversion means and antilog conversion means each includes passive elements capable of exhibiting log-linear and antilog-linear transfer characteristics. The passive elements are preferably in the form of diode elements connected in a diode bridge.

Other objects of the invention will in part be obvious and will in part appear hereinafter. The invention accordingly comprises the apparatus possessing the construction, combination of elements, and arrangement of parts which are exemplified in the following detailed disclosure, and the scope of the application of which will be indicated in the claims.

For a fuller understanding of the nature and objects of the present invention, reference should be had to the following detailed description taken in connection with the accompanying drawings wherein.

In the drawings the same numerals in the various figures refer to like parts.

Figure 1:
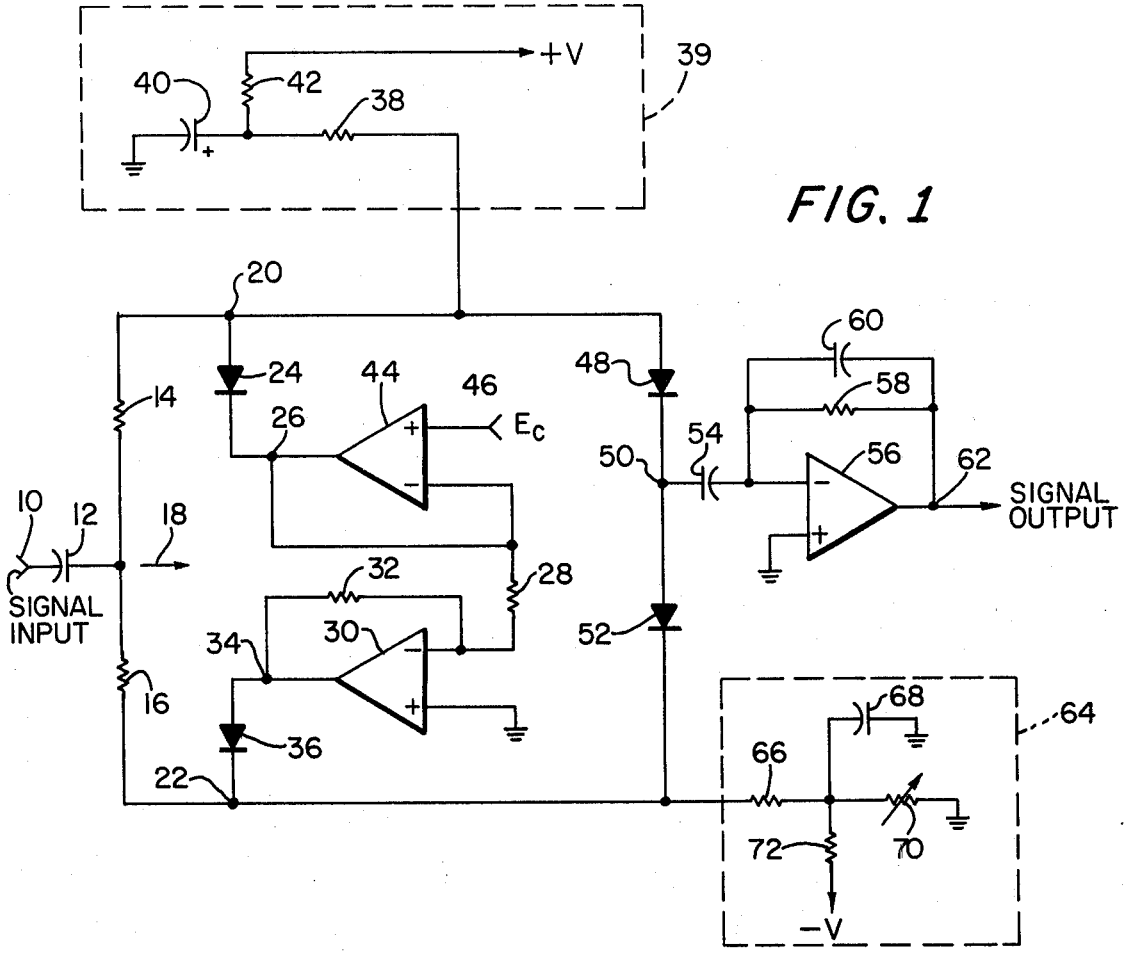
FIG. 1 shows a schematic circuit diagram of a preferred embodiment of the present invention.

Referring to FIG. 1, input terminal 10, which receives the input electrical signal such as an audio information signal, is connected to input capacitor 12. The latter, in turn, is connected through resistor 14 to junction 20 of a diode bridge, generally indicated at 18, and through resistor 16 to junction 22 of bridge 18 opposite to junction 20. The term "diode bridge" as used herein is not limited to a bridge circuit comprising four diodes, as shown and described hereinafter, but includes bridge circuits comprising any four passive elements capable of functioning as unidirectional current conducting means exhibiting logarithmic-linear and antilogarithmic-linear transfer characteristics, such as transistors, each connected in a diode mode. The diode elements accordingly can be a matched quad of Shottky (hot carrier) diodes or various transistors, such as Shottky transistors or microwave transistors, connected in a diode mode.

In the embodiment shown in FIG. 1 junction 20 is connected to the anode of a first log converting means shown in the form of diode 24, which in turn has its cathode connected to junction 26. Junction 26 is connected through resistor 28 to the negative input of operational amplifier 30. Amplifier 30 has its positive input connected to system ground and its negative input connected through resistor 32 to its output terminal at junction 34. Junction 34 is connected to the anode of second log converting means shown in the form of diode 36, while the cathode of diode 36 is connected to junction 22 of the bridge 18. As will be more apparent hereinafter diodes 24 and 36 function as to produce signals at junctions 26 and 34 in accordance with logarithmic functions of the input signal at control signal input terminal 46. The preferred circuit is designed to operate as a class A device. Diodes 24 and 36 are accordingly biased at a greater current level than the maximum expected peak levels of the input signal current at terminal 10. More specifically, junction 20 is connected to biasing means 39. Biasing means 39 preferably provides a positive current bias wherein junction 20 is connected to resistor 38, which in turn is connected through capacitor 40 to system ground and through resistor 42 to a positive reference voltage set well above the maximum expected peak levels of the signals applied to terminal 10, as well as the maximum diode voltage drops plus the control voltage applied to terminal 46.

As will be more evident hereinafter, means are provided for shunting the diode voltage levels at junctions 26 and 34 as a function of a control voltage level. More particularly, the shunting means comprises operational amplifier 30 and operational amplifier 44. The latter has its positive input terminal connected to the control signal input terminal 46 adapted to receive the control voltage signal. The output terminal of amplifier 44 is connected directly to the negative input terminal and to resistor 28 at junction 26.

Junction 20 of bridge circuit 18 is also connected to the anode of first antilog converting means shown in the form of diode 48 which in turn has its cathode connected to junction 50. Junction 50 is connected to the anode of second antilog converting means shown in the form of diode 52, which in turn has its cathode connected to junction 22. As will be more evident hereinafter diodes 48 and 52 function to produce signals at junction 50 in accordance with antilogarithmic functions of the combined signal produced at junctions 20 and 22 responsively to the input signal at terminal 10 and the control signal at control terminal 46. The antilog signals at junction 50 are applied through capacitor 54 to the negative input terminal of operational amplifier 56 which functions as a transimpedance amplifier having a fixed gain. The positive input terminal of amplifier 56 is connected to system ground. The negative input terminal of amplifier 56 is connected through each feedback resistor 58 and feedback capacitor 60 to the output terminal 62 of the amplifier 56 as well as the device.

Since it may be difficult to match diodes 24, 36, 48 and 52, junction 22 is preferably connected to symmetry adjusting means 64 for adjusting for asymmetry between the diodes. More specifically, junction 22 is connected to resistor 66. Resistor 66 is in turn connected through capacitor 68 to system ground, through variable resistor 70 to system ground and through resistor 72 to a negative reference potential.

In operation, as the signal current levels (below the level established by biasing means 39 and symmetry adjusting means 64) vary at the terminal 10, the voltage levels across the log converting diodes 24 and 36 will vary as a logarithmic function of those signal current levels. As the control voltage levels at control terminal 46 increase, at least when such control voltage levels are a positive polarity, this control voltage signal is injected into the diodes 24 and 36 so as to shunt less of the diode 24 having a similar effect on diode 36. The effect of shunting less of diodes 24 and 36 causes the antilog diodes 48 and 52 to conduct more heavily due to the nature of the diode bridge 18. The signals conducted through diodes 48 and 52 and thus the signal level at junction 50 is thus related as an antilogarithmic function of (1) the signal voltage appearing at junctions 20 and 22, which in turn is a function of the log of the input signal current, and (2) the control signal level Ec applied to control input terminal 46.

In essence by providing the control signal at control terminal 46 one is altering the dynamic impedance of the diodes so that the net result is substantially linear with little or no distortion of the signal.

As will be more evident by the analysis provided hereinafter, the above operation and results hold true for the embodiment shown in FIG. 1, so long as the control voltage is negative. So long as the control voltage is negative the gain increases negatively with an increasingly negative control signal in accordance with a substantially linear function as indicated by the graph shown in FIG. 4. Where however, the control voltage at terminal 46 is of a positive polarity, the gain has been found to be limited by the closed-loop transimpedance gain of amplifier 56. The multiplier circuit therefore in reality is a voltage variable attenuator and is particularly useful in compression or expansion of dynamically varying signals.

Figure 2:
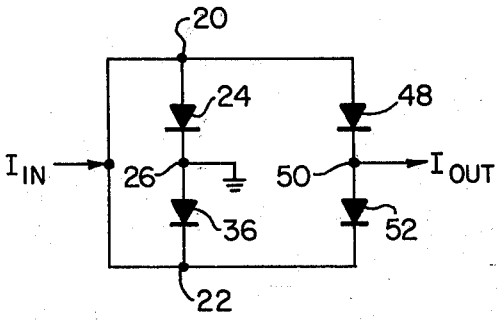
FIG. 2 is the schematic circuit diagram of FIG. 1, simplified for analytical purposes.
Figure 3:
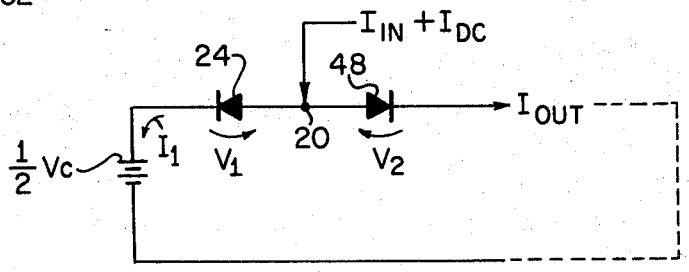
FIG. 3 is a further simplification of the circuit diagram of FIG. 2 in accordance with the bisection theorem.

The foregoing is evident when considering the circuit as a basic diode bridge circuit as shown in FIG. 2. Assuming that Iout at junction 50 is operated into virtual ground, as provided by amplifier 56 of FIG. 1 then the bisection theorem can be used to provide the equivalent half circuit shown in FIG. 3. As shown in FIG. 3 the current input at junction 20 is due to the input current Iin derived from the input signal applied to input terminal 10 and $I_{DC}$, the biasing current from biasing means 39. The control voltage applied to control terminal 46 through amplifier 44 to junction 26 is represented in FIG. 3 by a D.C. potential Vc/2 equal to one-half the D.C. control voltage Vc. Accordingly, the following relationship can be stated:

$$\frac{\Delta I\text{out}}{\Delta I\text{in}} = \frac{I_1^{-1}}{I\text{out}^{-1} + I_1^{-1}} = \frac{R_{24}}{R_{24} + R_{48}} \tag{1}$$

where $I_1$ = the forward bias through diode 24.

$R_{24}$ = the resistance value offered by diode 24; and $R_{48}$ = the resistance value offered by diode 48.

From the relationship of equation 1, it will be evident that for an incremental increase in Vc/2, (i.e. $\Delta Vc/2 > 0$ or an incremental increase in the control voltage), $R_{24}$ increases and $R_{48}$ decreases. As a consequence the current through diode 24 decreases and the current through diode 48 increases while the change in the reversed-biased voltage ($\Delta V_1$) across diode 24 is changing by $-\Delta Vc/2$ and the change in reverse-biased voltage ($\Delta V_2$) across diode 48 is changing by $+\Delta Vc/2$.

The following can therefore be derived from inspection as being a well known current-voltage relationship of diodes:

$$I_1 = Ke^{-(q/RT)\left(\frac{\Delta Vc}{2}\right)}; \text{ and} \tag{2}$$

wherein

K = a constant q = charge

R = Boltzmann constant

T = absolute temperature $$I\text{out} = Ke^{+(q/RT)\left(\frac{+\Delta Vc}{2}\right)} \tag{3}$$

Substituting into equation (1)

$$\frac{\Delta I_{out}}{\Delta I_{in}} = \left[ \frac{Ke^{+(q/RT)(\frac{V_c}{2})}}{K\left[e^{(q/RT)(\frac{V_c}{2})} + e^{-(q/RT)(V_c/2)}\right]} \right], \text{ or} \quad (4)$$

$$\frac{\Delta I_{out}}{\Delta I_{in}} = \left[1 + e^{\frac{-qV_c}{RT}}\right]^{-1} \quad (5)$$

Figure 4:
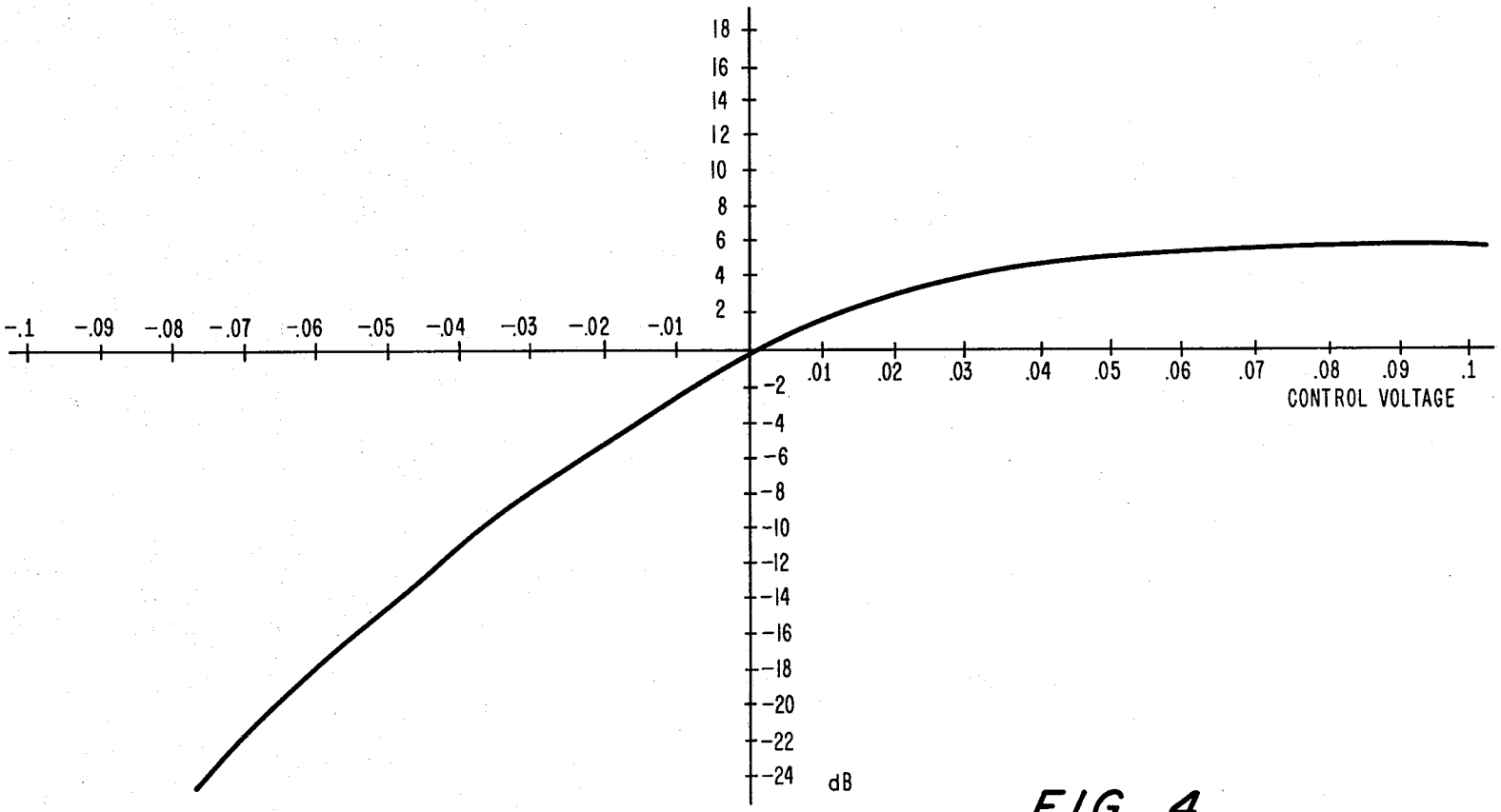
FIG. 4 is a graphical illustration of a typical control voltage-gain curve of a circuit designed in accordance with the schematic of FIG. 1.

As shown in FIG. 4, measurements of gain vs. control voltage of a typical multiplier circuit built in accordance with the circuit topology of FIG. 1 were taken and plotted with the illustrated graph being the result. These measurements and illustrated curve agree with equations (4) and (5).

Although maximum noise will occur when Ec=0, this represents positive gain (in decibels) since the transimpedance amplifier 56 is scaled upwards in gain. Otherwise the circuit provides about a 6 dB gain as shown. Scaling the gain of transimpedance amplifier 56 upwards requires the circuit to operate at a lower input level for a given output signal level, thus gaining a distortion advantage. Finally, at large negative control voltages, distortion is relatively low, and the crossover bias current provided by biasing means 39 and symmetry adjusting means 64 does not figure into the distortion.

The multiplier circuit of the present invention has several advantages over the prior art devices. By using passive elements in the form of diodes elements 24, 36, 48 and 52, the circuit described in FIG. 1 can easily be manufactured in integrated form. In fact diode quads are already inexpensively commercially available in integrated form and can be easily utilized as diode bridge 18. Moreover, the circuit topology results in an open loop type of VCA having a greater frequency response when compared with the frequency responses of many closed loop VCAs.

Since certain changes may be made in the above without departing from the scope of the invention herein involved, it is intended that all matter contained in the above description or shown in the accompanying drawing shall be interpreted in an illustrative and not in a limiting sense.

What is claimed is:

1. A multiplier circuit comprising, in combination:

an input terminal for receiving an electrical input signal;

four diode elements connected together to form a diode bridge of two logarithmic responsive elements coupled together to form one side of said bridge and to provide a first junction therebetween, and two antilogarithmic responsive elements coupled together to form the other side of said bridge and to provide a second junction therebetween, said diode bridge being coupled to said input terminal so that a log signal is produced at said first junction as a logarithmic function of said input signal;

means, responsive to a control signal, for shunting the two logarithmic responsive elements at said first junction as a function of said control signal and for producing a signal at said second junction as a function of the sum of said input signal and said control signal; and amplification means coupled to said second junction and responsive to signal at said second junction, for producing an output signal as a function of the antilog of the sum of said log signal and said control signal.

2. A multiplier circuit according to claim 1, further including means for biasing said diode bridge at a biasing level above the expected peak levels of said input signal.

3. A multiplier circuit according to claim 1, wherein said means for shunting said two logarithmic responsive element comprises an operational amplifier having its output connected to said first junction and an input connected to receive said control signal.

4. A multiplier circuit according to claim 1 wherein said amplification means comprises a transimpedance amplifier.

5. A multiplier circuit according to claim 1, wherein said transimpedance amplifier has a fixed gain.

6. A multiplier circuit according to claim 1, further includes means for providing symmetry of said diode bridge.

* * * * *